US011685623B2

(12) United States Patent
Morita et al.

(10) Patent No.: US 11,685,623 B2
(45) Date of Patent: Jun. 27, 2023

(54) SHEET CONVEYING DEVICE AND IMAGE FORMING APPARATUS

(71) Applicant: KYOCERA Document Solutions Inc., Osaka (JP)

(72) Inventors: Takuro Morita, Osaka (JP); Yuya Shimohora, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/674,147

(22) Filed: Feb. 17, 2022

(65) Prior Publication Data

US 2022/0267110 A1 Aug. 25, 2022

(30) Foreign Application Priority Data

Feb. 25, 2021 (JP) ..... 2021-028359

(51) Int. Cl.

| | |
|---|---|
| ***B65H 9/00*** | (2006.01) |
| ***B65H 9/10*** | (2006.01) |
| ***G03G 15/16*** | (2006.01) |
| ***G03G 15/00*** | (2006.01) |
| *B65H 7/02* | (2006.01) |

(52) U.S. Cl.

CPC ..... *B65H 9/002* (2013.01); *B65H 9/106* (2013.01); *G03G 15/16* (2013.01); *G03G 15/6529* (2013.01); *B65H 7/02* (2013.01); *B65H 2404/144* (2013.01); *B65H 2404/172* (2013.01)

(58) Field of Classification Search

CPC .. G03G 15/6558; G03G 15/6567; B65H 9/00; B65H 9/002; B65H 9/10; B65H 9/106; B65H 9/20; B65H 7/02; B65H 7/06; B65H 2404/144; B65H 2404/1421; B65H 2404/1424; B65H 2404/172

USPC ..... 271/184, 226, 227, 253

See application file for complete search history.

(56) References Cited

U.S. PATENT DOCUMENTS

| | | | | |
|---|---|---|---|---|
| 6,578,844 | B2 * | 6/2003 | Acquaviva | B65H 7/08 271/228 |
| 7,422,209 | B2 * | 9/2008 | Hashimoto | B65H 9/002 271/228 |
| 7,472,905 | B2 * | 1/2009 | Inoue | B65H 9/006 271/227 |

(Continued)

FOREIGN PATENT DOCUMENTS

JP 2018-95466 A 6/2018

*Primary Examiner* — Leslie A Nicholson, III

(74) *Attorney, Agent, or Firm* — Stein IP, LLC

(57) ABSTRACT

A sheet conveying device includes a sheet detection unit and a position adjusting mechanism. The position adjusting mechanism is disposed on a downstream side of the sheet detection unit in a sheet conveying direction in the sheet conveying path, includes an adjusting roller pair, and performs skew correction and positional displacement correction of a sheet, while conveying the sheet. The sheet conveying path includes a first conveying roller pair disposed on an upstream side of the position adjusting mechanism in the sheet conveying direction, and a curved part disposed between the adjusting roller pair and the first conveying roller pair, which curves in an S shape so as to be convex in a front and back side direction of the sheet alternately at different positions in the sheet conveying direction. The adjusting roller pair nips and conveys the sheet together with the first conveying roller pair.

3 Claims, 7 Drawing Sheets

(56) References Cited

U.S. PATENT DOCUMENTS

| | | | | |
|---|---|---|---|---|
| 8,328,188 | B2 * | 12/2012 | Mandel | B65H 9/002 271/228 |
| 9,776,819 | B2 * | 10/2017 | Yamane | B65H 9/002 |
| 10,358,309 | B2 * | 7/2019 | Yamane | G03G 15/6567 |
| 10,773,913 | B2 * | 9/2020 | Matsumoto | B65H 9/006 |
| 11,148,892 | B2 * | 10/2021 | Egawa | B65H 7/06 |
| 11,445,082 | B2 * | 9/2022 | Arai | G03G 15/6555 |
| 2009/0166960 | A1 * | 7/2009 | Ishikawa | B65H 9/106 271/227 |

* cited by examiner

SHEET CONVEYING DEVICE AND IMAGE FORMING APPARATUS

INCORPORATION BY REFERENCE

This application is based upon and claims the benefit of priority from the corresponding Japanese Patent Application No. 2021-028359 filed Feb. 25, 2021, the entire contents of which are hereby incorporated by reference.

BACKGROUND

The present disclosure relates to a sheet conveying device and an image forming apparatus.

There is known an image forming apparatus, which performs skew correction to correct skew of a sheet conveyed along a sheet conveying path with respect to a sheet conveying direction, and performs positional displacement correction to correct positional displacement of the sheet in a sheet width direction perpendicular to the sheet conveying direction.

For instance, a conventional image forming apparatus includes pinch rollers for conveying a sheet-like body along a predetermined conveying path, an upstream detection unit and a downstream detection unit for detecting positional displacement amount of the sheet-like body at upstream and downstream of the pinch rollers, respectively, and a roller moving mechanism for moving the pinch rollers so as to correct the positional displacement amount of the sheet-like body. A control unit of the image forming apparatus controls the roller moving mechanism on the basis of an upstream positional displacement amount and a downstream positional displacement amount of the sheet-like body. In this way, accuracy of the positional displacement correction of the sheet-like body can be improved.

SUMMARY

A sheet conveying device according to one aspect of the present disclosure includes a sheet detection unit and a position adjusting mechanism. The sheet detection unit is disposed in a sheet conveying path, so as to detect skew of a conveyed sheet with respect to a sheet conveying direction, and to detect a positional displacement amount of the sheet in a sheet width direction perpendicular to the sheet conveying direction. The position adjusting mechanism is disposed in the sheet conveying path on a downstream side of the sheet detection unit in the sheet conveying direction, and is configured to perform skew correction to correct the skew of the sheet, and to perform positional displacement correction to correct the positional displacement of the sheet, on the basis of a detection result of the sheet detection unit, while conveying the sheet. The position adjusting mechanism includes an adjusting roller pair, a skew correction motor, and a positional displacement correction motor. The adjusting roller pair nips and conveys the sheet. The skew correction motor tilts rotation shafts of the adjusting roller pair with respect to the sheet conveying direction. The positional displacement correction motor moves the adjusting roller pair in the sheet width direction. The sheet conveying path includes a first conveying roller pair disposed on an upstream side of the position adjusting mechanism in the sheet conveying direction, and a curved part disposed between the adjusting roller pair and the first conveying roller pair, the curved part curving in an S shape in a front and back side direction of the sheet. The adjusting roller pair nips and conveys the sheet together with the first conveying roller pair.

DETAILED DESCRIPTION

Hereinafter, an embodiment of the present disclosure is described with reference to the drawings. Note that the present disclosure is not limited to the following description.

Figure 1:
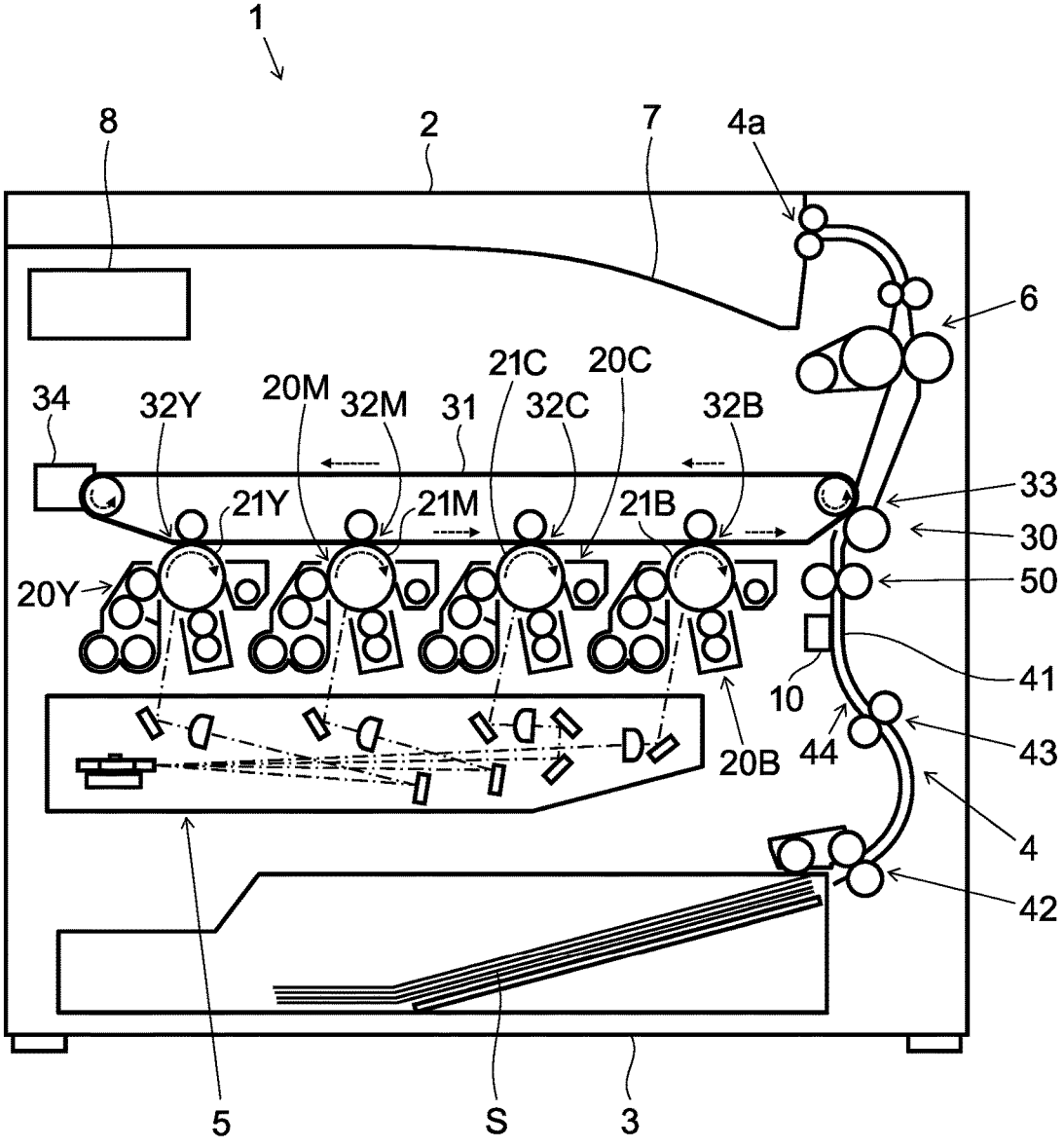
FIG. 1 is a schematic cross-sectional front view illustrating a structure of an image forming apparatus according to an embodiment of the present disclosure.
Figure 2:
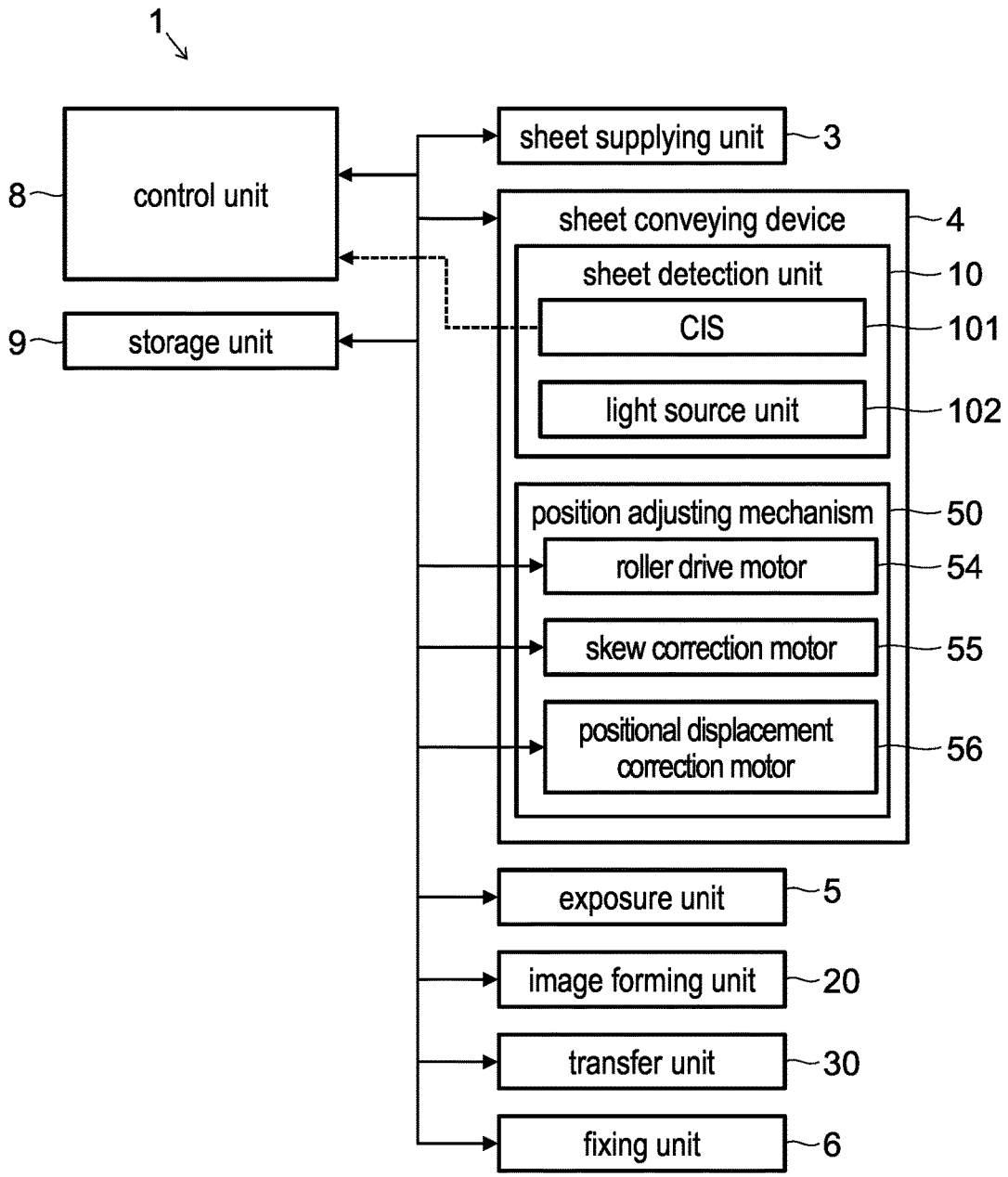
FIG. 2 is a block diagram illustrating a schematic structure of the image forming apparatus of FIG. 1.

FIG. 1 is a schematic cross-sectional front view illustrating a structure of an image forming apparatus 1 of the embodiment. FIG. 2 is a block diagram illustrating a schematic structure of the image forming apparatus 1 of FIG. 1. An example of the image forming apparatus 1 of this embodiment is a tandem type color printer that transfers a toner image onto a sheet S using an intermediate transfer belt 31. The image forming apparatus 1 may be a so-called multifunction peripheral having functions of printing, scanning (image reading), facsimile sending, and the like.

As illustrated in FIGS. 1 and 2, the image forming apparatus 1 includes a sheet supplying unit 3, a sheet conveying device 4, an exposure unit 5, an image forming unit 20, a transfer unit 30, a fixing unit 6, a sheet discharge unit 7, a control unit 8, and a storage unit 9, which are disposed in its main body 2.

The sheet supplying unit 3 stores a plurality of sheets S and sends out the sheets S one by one in separation when printing is performed. The sheet conveying device 4 includes a sheet conveying path 41, which conveys the sheet S sent out from the sheet supplying unit 3 to a secondary transfer unit 33 and the fixing unit 6, and further discharges the sheet S after fixing process through a sheet discharge outlet 4*a* to the sheet discharge unit 7. The exposure unit 5 emits a laser beam controlled based on image data toward the image forming unit 20.

The image forming unit 20 is disposed below the intermediate transfer belt 31. The image forming unit 20 includes a yellow image forming unit 20Y, a magenta image forming unit 20M, a cyan image forming unit 20C, and a black image forming unit 20B. These four image forming units 20 have the same basic structure. Accordingly, in the following description, the symbols Y, M, C, and B indicating colors may be omitted unless it is necessary to specify the color.

The image forming unit 20 includes a photosensitive drum (image carrier) 21 supported in a manner rotatable in a predetermined direction (clockwise direction in FIG. 1). The photosensitive drum 21 is disposed with its rotation shaft in a horizontal position. The image forming unit 20 further includes a charging unit, a developing unit, and a drum cleaning unit disposed along its rotation direction around the photosensitive drum 21. Note that a primary transfer unit 32 is disposed between the developing unit and the drum cleaning unit.

The photosensitive drum 21 has a photosensitive layer on its outer circumferential surface. The charging unit charges the outer circumferential surface of the photosensitive drum 21 at a predetermined potential. The exposure unit 5 exposes the outer circumferential surface of the photosensitive drum 21 charged by the charging unit, so as to form an electrostatic latent image of a document image on the outer circumferential surface of the photosensitive drum 21. The developing unit allows toner to adhere to the electrostatic latent image for development, so as to form a toner image. The four image forming units 20 form toner images having different colors. The drum cleaning unit cleans the outer circumferential surface of the photosensitive drum 21 by removing toner and the like, which has remained on the same after the toner image is primarily transferred onto the outer periphery surface of the intermediate transfer belt 31.

The transfer unit 30 includes the intermediate transfer belt 31, the primary transfer units 32Y, 32M, 32C, and 32B, the secondary transfer unit 33, and a belt cleaning unit 34. The intermediate transfer belt 31 is disposed above the four image forming units 20. The intermediate transfer belt 31 is an intermediate transfer body, which is supported in a manner rotatable in a predetermined direction (anticlockwise direction in FIG. 1), and on which the toner images formed by the four image forming units 20 are sequentially overlaid and primarily transferred. The four image forming units 20 are disposed in a line from the upstream side to the downstream side in the turning direction of the intermediate transfer belt 31, as a so-called tandem type arrangement.

The primary transfer units 32Y, 32M, 32C, and 32B are disposed above the image forming units 20Y, 20M, 20C, and 20B of the individual colors, via the intermediate transfer belt 31. The secondary transfer unit 33 is disposed on the upstream side of the fixing unit 6 in the sheet conveying direction in the sheet conveying device 4, and on the downstream side of the image forming units 20Y, 20M, 20C, and 20B of the individual colors in the turning direction of the intermediate transfer belt 31 in the transfer unit 30. The belt cleaning unit 34 is disposed, for example, on the upstream side of the image forming units 20Y, 20M, 20C, and 20B of the individual colors in the turning direction of the intermediate transfer belt 31.

The toner images are primary transferred onto the outer periphery surface of the intermediate transfer belt 31 by the primary transfer units 32Y, 32M, 32C, and 32B of the individual colors. Further, along with the turning of the intermediate transfer belt 31, the toner images of the four image forming units 20 are sequentially overlaid at predetermined timings and are transferred onto the intermediate transfer belt 31, and hence the color toner image is formed on the outer periphery surface of the intermediate transfer belt 31, in which the yellow, magenta, cyan, and black toner images are overlaid.

The color toner image on the outer periphery surface of the intermediate transfer belt 31 is transferred onto the sheet S that is conveyed synchronously by the sheet conveying device 4, at a secondary transfer nip of the secondary transfer unit 33. In other words, the transfer unit 30 transfers the toner images formed on the surfaces of the four photosensitive drums 21 onto the sheet S using the intermediate transfer belt 31. The belt cleaning unit 34 cleans the outer periphery surface of the intermediate transfer belt 31 by removing toner and the like, which are remained after the secondary transfer.

The fixing unit 6 is disposed on the downstream side of the secondary transfer unit 33 in the sheet conveying direction in the sheet conveying device 4, and above the secondary transfer unit 33. The fixing unit 6 applies heat and pressure to the sheet S with the transferred toner image so that the toner image is fixed to the sheet S.

The sheet discharge unit 7 is disposed above the transfer unit 30. The sheet S with the fixed toner image after completion of printing is conveyed to the sheet discharge unit 7.

The control unit 8 includes a CPU, an image processing unit, and other electronic circuits and electronic components (which are not shown). The CPU controls operations of individual units of the image forming apparatus 1 on the basis of a control program and data stored in the storage unit 9, so as to perform processing related to functions of the image forming apparatus 1. The sheet supplying unit 3, the sheet conveying device 4, the exposure unit 5, the image forming unit 20, the transfer unit 30, and the fixing unit 6 are individually commanded from the control unit 8, and cooperate in performing printing on the sheet S.

The storage unit 9 is constituted of a combination of a nonvolatile storage device such as a program read only memory (ROM) and a data ROM, and a volatile storage device such as a random access memory (RAM), for example.

In addition, the sheet conveying device 4 includes a sheet detection unit 10 and a position adjusting mechanism 50 in addition to the sheet conveying path 41. Note that the sheet conveying path 41 extend in a substantially up and down direction from the upstream side of the sheet detection unit 10 in the sheet conveying direction to the downstream side of the position adjusting mechanism 50 in the sheet conveying direction. In addition, the sheet conveying path 41 is equipped with a plurality of conveying roller pairs, including a first conveying roller pair 42 and a second conveying roller pair 43 disposed on the upstream side of the position adjusting mechanism 50 in the sheet conveying direction.

The sheet detection unit 10 is disposed in the sheet conveying path 41 on the upstream side of the secondary transfer unit 33 of the transfer unit 30 in the sheet conveying direction (on the lower side of the secondary transfer unit 33 in FIG. 1). The sheet detection unit 10 includes, for example, a contact image sensor (CIS) 101 and a light source unit 102 (see FIG. 2). The contact image sensor 101 extends over the entire sheet width (in the depth direction of paper of FIG. 1) perpendicular to the sheet conveying direction of the sheet conveying path 41.

The contact image sensor 101 detects ends of the sheet S in the sheet conveying direction (the up and down direction in FIG. 1) and in the sheet width direction (the depth direction of paper of FIG. 1), on the basis of a light intensity difference between the part into which light enters from the light source unit 102 and the part where the light is blocked by the sheet S. In this way, the sheet detection unit 10 detects the skew of the sheet S conveyed in the sheet conveying path 41 with respect to the sheet conveying direction Dc, and detects a positional displacement amount of the sheet S in the sheet width direction Dw.

The position adjusting mechanism 50 is disposed in the sheet conveying path 41 on the upstream side of the secondary transfer unit 33 of the transfer unit 30 in the sheet conveying direction (on the lower side of the secondary transfer unit 33 in FIG. 1), and on the downstream side of the sheet detection unit 10 in the sheet conveying direction (on the upper side of the sheet detection unit 10 in FIG. 1). The position adjusting mechanism 50 has a function of conveying the sheet S and a function of correcting a conveying position of the sheet S. Specifically, the position adjusting mechanism 50 performs skew correction to correct skew of the sheet S with respect to the sheet conveying direction and positional displacement correction to correct positional displacement of the sheet S with respect to the sheet width direction, on the basis of a detection result of the sheet detection unit 10, while conveying the sheet S. The control unit 8 controls the position adjusting mechanism 50.

Figure 3:
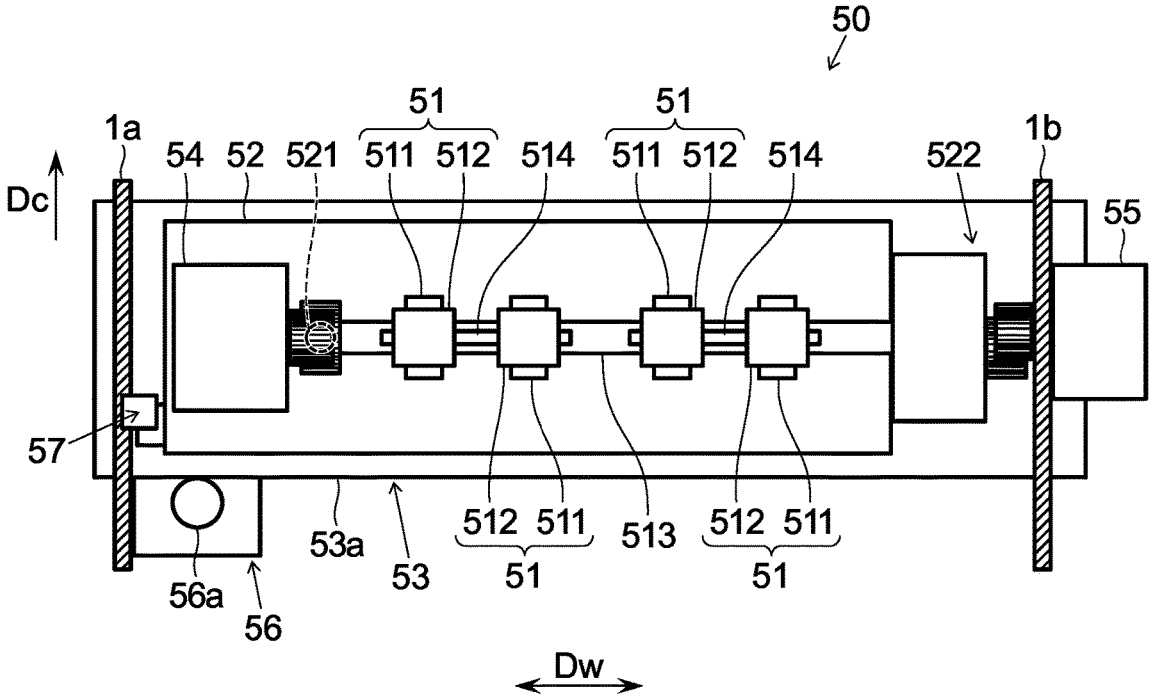
FIG. 3 is a side view of a position adjusting mechanism of the image forming apparatus of FIG. 1.
Figure 4:
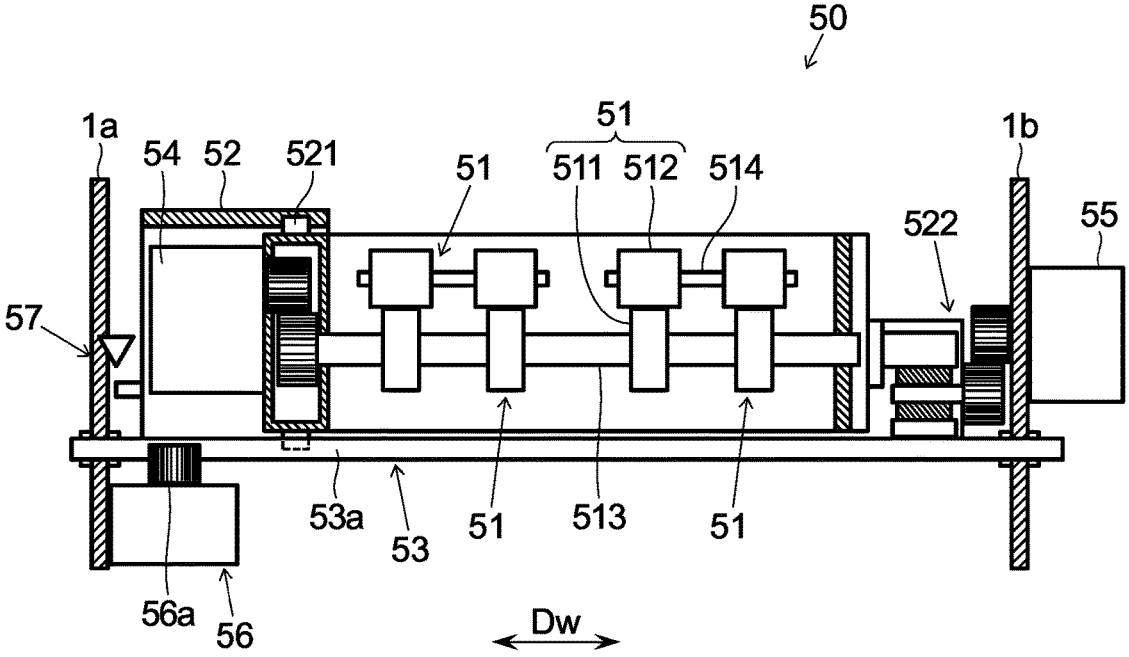
FIG. 4 is a bottom view of the position adjusting mechanism of FIG. 3.

Next, a structure of the position adjusting mechanism 50 is described below with reference to FIGS. 3 and 4 in addition to FIGS. 1 and 2. FIG. 3 is a side view of the position adjusting mechanism 50 of the image forming apparatus 1 of FIG. 1. FIG. 4 is a bottom view of the position adjusting mechanism 50 of FIG. 3. Note that the sheet conveying direction Dc and the sheet width direction Dw are indicated in FIG. 3 and following figures.

As illustrated in FIGS. 3 and 4, the position adjusting mechanism 50 includes an adjusting roller pair 51, a roller holder 52, a carriage 53, a roller drive motor 54, a skew correction motor 55, a positional displacement correction motor 56, and a reference position detection unit 57.

A plurality of adjusting roller pairs 51, for example four pairs in this embodiment, are disposed in the sheet width direction Dw. The adjusting roller pair 51 includes a drive roller 511 and a driven roller 512. The drive roller 511 is fixed to a rotation shaft 513, and is rotated by the roller drive motor 54 via the rotation shaft 513. The driven roller 512 has a periphery surface that contacts with a periphery surface of the drive roller 511, so as to rotate following rotation of the drive roller 511. The adjusting roller pair 51 nips and conveys the sheet S.

The roller holder 52 supports the rotation shaft 513 of the drive roller 511 and a rotation shaft 514 of the driven roller 512 in a rotatable manner. On one end side of the roller holder 52 in the sheet width direction Dw (the left end side in FIGS. 3 and 4, a support end), there is disposed a rocking support shaft 521 extending in the normal direction to the conveying surface for the sheet S (the depth direction of paper of FIG. 3, the up and down direction in FIG. 4). The roller holder 52 has the other side in the sheet width direction Dw (the right end side in FIGS. 3 and 4, a rocking end), which can rock about the rocking support shaft 521 in the sheet conveying direction Dc with respect to the carriage 53.

The carriage 53 supports the roller holder 52. The carriage 53 is supported by a front side frame 1*a* and a back side frame 1*b* of the image forming apparatus 1 in a manner movable in the sheet width direction Dw.

The roller drive motor 54 is disposed on the support end side of the roller holder 52 in the sheet width direction Dw (the left end side in FIGS. 3 and 4). The roller drive motor 54 is linked to the rotation shaft 513 of the drive roller 511 via a plurality of gears. The roller drive motor 54 starts or stops rotation of the rotation shaft 513. In other words, the roller drive motor 54 starts or stops rotation of the drive roller 511.

The skew correction motor 55 is linked to a rack 522 disposed on the rocking end side of the roller holder 52 in the sheet width direction Dw (the right end side in FIGS. 3 and 4) via a plurality of gears. The skew correction motor 55 allows the rocking end side of the roller holder 52 in the sheet width direction Dw to rock about the rocking support shaft 521 in the sheet conveying direction Dc. In other words, the skew correction motor 55 changes inclination of the roller holder 52 with respect to the sheet conveying direction Dc. In other words, the skew correction motor 55 can tilt the rotation shafts 513 and 514 of the adjusting roller pair 51 with respect to the sheet conveying direction Dc.

The positional displacement correction motor 56 is linked to rack teeth (not shown) formed on one end edge 53*a* of the carriage 53 in the sheet conveying direction Dc via a gear 56*a*. The positional displacement correction motor 56 allows the carriage 53 to move in the sheet width direction Dw. In other words, the positional displacement correction motor 56 can move the adjusting roller pair 51 in the sheet width direction Dw.

Note that, for example, stepping motors are used for the roller drive motor 54, the skew correction motor 55, and the positional displacement correction motor 56. The stepping motor can accurately control rotation direction and rotation amount (rotation angle) by pulse control.

The reference position detection unit 57 is disposed on the front side frame 1*a* of the image forming apparatus 1. The reference position detection unit 57 includes an optical sensor attached to the front side frame 1*a*, for example, having a light emitting part and a light receiving part, and a light blocking plate that is attached to the roller holder 52 and enters or retreats from an optical path of the optical sensor. The reference position detection unit 57 detects a reference position of the roller holder 52. The reference position of the roller holder 52 has zero inclination with respect to the sheet conveying direction Dc (i.e., perpendicular to the sheet conveying direction Dc), and is the center position in the sheet width direction Dw in the sheet conveying path 41.

The position adjusting mechanism 50 having the structure described above uses the adjusting roller pair 51 to perform the skew correction to correct skew of the sheet S in the sheet conveying direction Dc, and the positional displacement correction to correct positional displacement of the sheet S in the sheet width direction Dw, while conveying the sheet S. In the skew correction of the sheet S, the position adjusting mechanism 50 tilts the roller holder 52 (adjusting roller pair 51) with respect to the sheet conveying direction Dc using the skew correction motor 55. In the positional displacement correction of the sheet S, the position adjusting mechanism 50 moves the roller holder 52 (adjusting roller pair 51) in the sheet width direction Dw using the positional displacement correction motor 56.

Next, an operation example of the skew correction and the positional displacement correction of the sheet S using the position adjusting mechanism 50 is described below. FIGS. 5 to 8 are schematic side views illustrating first to fourth steps of transition of the skew correction and the positional displacement correction by the position adjusting mechanism 50. Note that the second conveying roller pair 43 is not shown in FIGS. 5 to 8.

Figure 5:
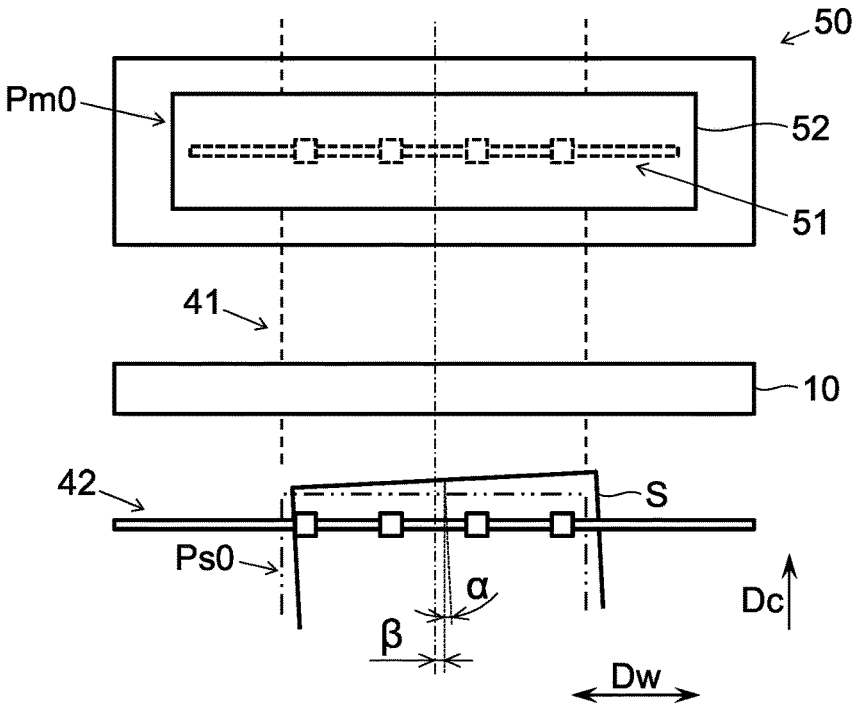
FIG. 5 is a schematic side view illustrating a first step of transition of skew correction and positional displacement correction by the position adjusting mechanism of FIG. 3.

As illustrated in FIG. 5, before the sheet S conveyed to the secondary transfer unit 33 of the transfer unit 30 reaches the sheet detection unit 10, the roller holder 52 of the position adjusting mechanism 50 is located at the reference position Pm0. In other words, the roller holder 52 has zero inclination with respect to the sheet conveying direction Dc (perpendicular to the sheet conveying direction Dc), and is at the center position in the sheet width direction Dw in the sheet conveying path 41.

For instance, as illustrated in FIG. 5, if the sheet S has a skew angle of a and a positional displacement of β with respect to the reference position Ps0 (having zero skew with respect to the sheet conveying direction Dc and being at the center in the sheet width direction Dw in the sheet conveying path 41), the skew and the positional displacement of the sheet S are detected by the sheet detection unit 10.

Figure 6:
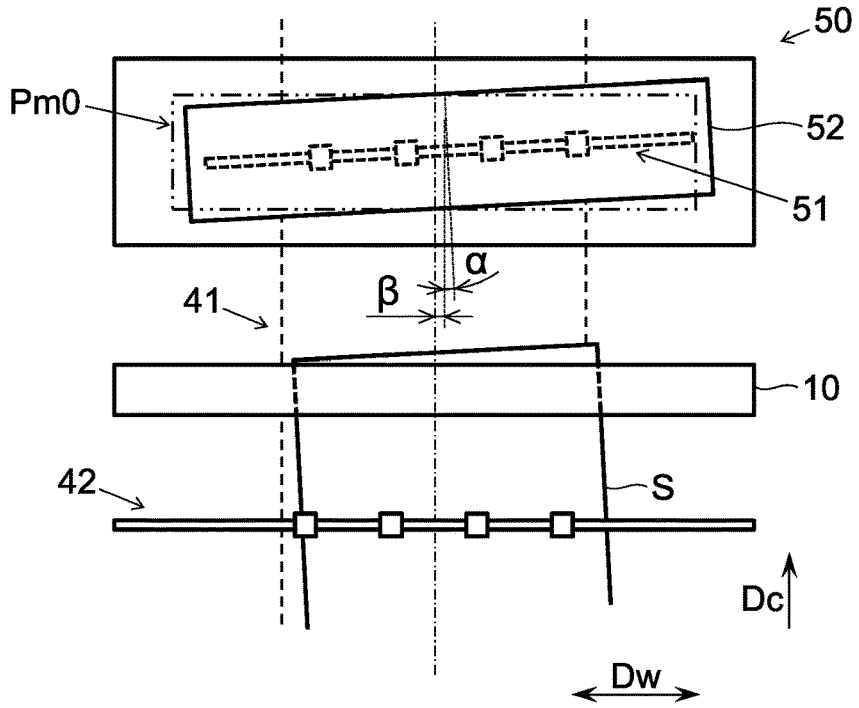
FIG. 6 is a schematic side view illustrating a second step of the transition of the skew correction and the positional displacement correction by the position adjusting mechanism of FIG. 3.

As illustrated in FIG. 6, when the sheet S reaches the sheet detection unit 10, the sheet detection unit 10 uses the contact image sensor 101 so as to detect the skew of the sheet S conveyed to the secondary transfer unit 33 of the transfer unit 30 with respect to the sheet conveying direction Dc and the positional displacement amount of the sheet S in the sheet width direction Dw. The detection information of the sheet S by the sheet detection unit 10 is sent to the control unit 8.

The control unit 8 controls the position adjusting mechanism 50 on the basis of the detection information of the sheet S by the sheet detection unit 10. Specifically, the control unit 8 derives a control signal for the position adjusting mechanism 50 on the basis of the detection information of the sheet S detected by the sheet detection unit 10, and sends the control signal to the position adjusting mechanism 50.

The control unit 8 controls the roller holder 52 to move. Specifically, in the position adjusting mechanism 50, the skew correction motor 55 is controlled, so that the roller holder 52 is given an angle α of tilt with respect to the sheet conveying direction Dc, and the positional displacement correction motor 56 is controlled, so that the roller holder 52 is moved by a distance β in the sheet width direction Dw. The skew correction motor 55 and the positional displacement correction motor 56 are stepping motors, for example, and the rotation direction and the rotation amount (rotation angle) thereof are controlled by pulse control.

Figure 7:
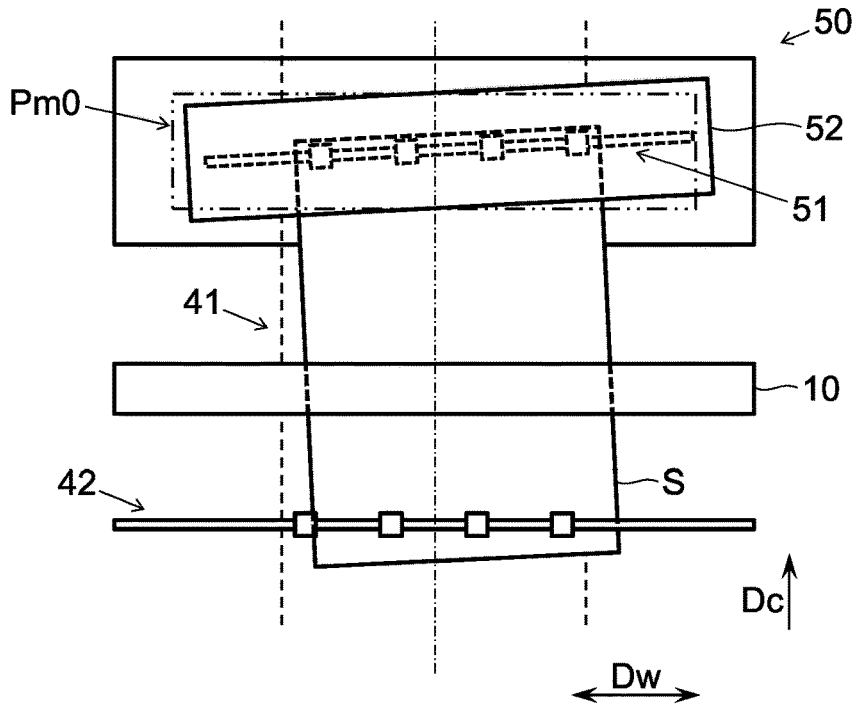
FIG. 7 is a schematic side view illustrating a third step of the transition of the skew correction and the positional displacement correction by the position adjusting mechanism of FIG. 3.

As illustrated in FIG. 7, when the sheet S reaches the position adjusting mechanism 50, the control unit 8 performs the skew correction and the positional displacement correction. Note that in this case, in the sheet conveying path 41, the sheet S is held and conveyed by the adjusting roller pair 51 and the first conveying roller pair 42 disposed on the upstream side of the adjusting roller pair 51 in the sheet conveying direction.

Figure 8:
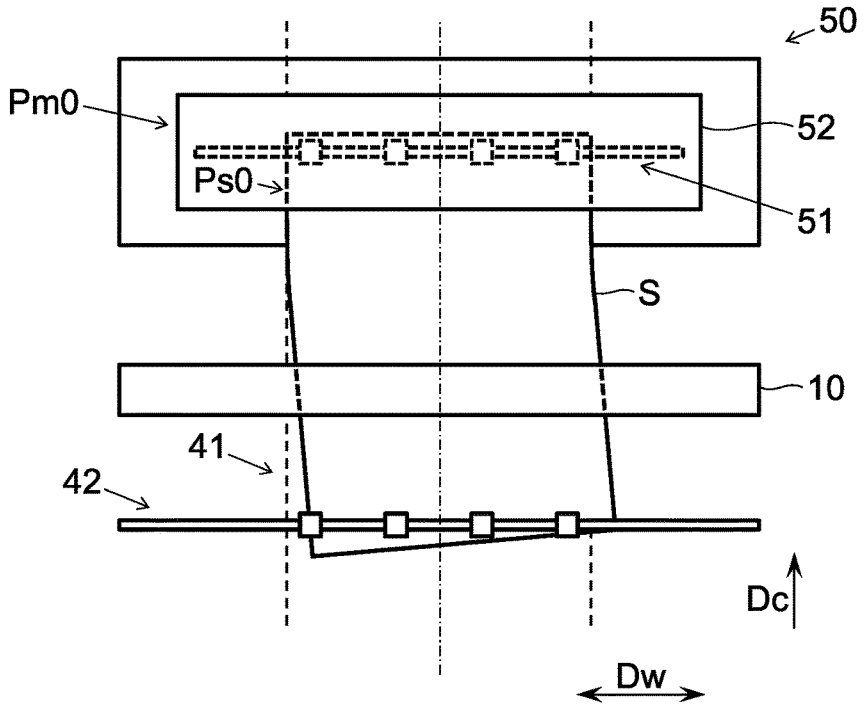
FIG. 8 is a schematic side view illustrating a fourth step of the transition of the skew correction and the positional displacement correction by the position adjusting mechanism of FIG. 3.

In this way, as illustrated in FIG. 8, the position adjusting mechanism 50 restores the roller holder 52 to the reference position Pm0 while conveying the sheet S with the adjusting roller pair 51. In this way, the region of the sheet S held by the adjusting roller pair 51 moves to the reference position Ps0. Then, the control unit 8 sends the sheet S, which is adjusted to an appropriate position in the sheet conveying path 41 by the position adjusting mechanism 50, to the secondary transfer unit 33 of the transfer unit 30. In this way, the entire sheet S is moved to the reference position Ps0.

Figure 9:
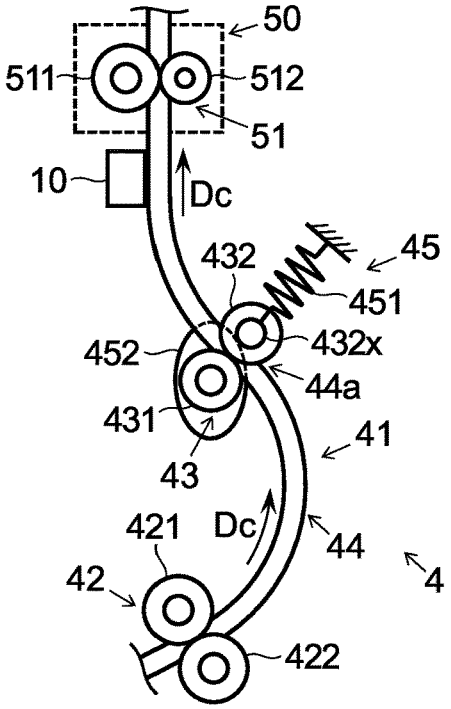
FIG. 9 is a schematic front view of a curved part of a sheet conveying path in the image forming apparatus of FIG. 1.
Figure 10:
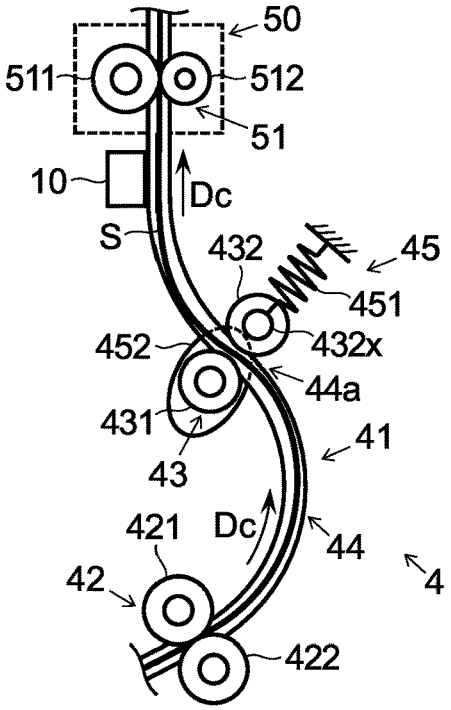
FIG. 10 is a schematic front view of the curved part of the sheet conveying path of FIG. 9, and is a diagram illustrating a state when operating the position adjusting mechanism.

Next, a structure of the sheet conveying path 41 on the upstream side of the position adjusting mechanism 50 in the sheet conveying direction is described below with reference to FIGS. 9 and 10. FIG. 9 is a schematic front view of a curved part 44 of the sheet conveying path 41 of the image forming apparatus 1 illustrated in FIG. 1. FIG. 10 is a schematic front view of the curved part 44 of the sheet conveying path 41 illustrated in FIG. 9, and is a diagram illustrating a state when operating the position adjusting mechanism 50.

The sheet conveying path 41 includes the first conveying roller pair 42, the curved part 44, the second conveying roller pair 43, and a contact-separation mechanism 45, on the upstream side of the position adjusting mechanism 50 in the sheet conveying direction Dc.

The first conveying roller pair 42 is disposed on the upstream side of the position adjusting mechanism 50 in the sheet conveying direction Dc. The first conveying roller pair 42 is constituted of a drive roller 421 and a driven roller 422, for example. The drive roller 421 is rotated by a motor (not shown). The driven roller 422 has a periphery surface that contacts with a periphery surface of the drive roller 421, so as to rotate following rotation of the drive roller 421. The first conveying roller pair 42 holds and conveys the sheet S with the conveying nip formed between the drive roller 421 and the driven roller 422.

The curved part 44 is disposed between the adjusting roller pair 51 and the first conveying roller pair 42. The curved part 44 is curved in an S shape in the front and back side direction of the sheet S. Specifically, the curved part 44 is curved in an S shape in such a manner to be convex toward front and back sides of the sheet S alternately at different positions in the sheet conveying direction Dc. More specifically, a downstream part of the curved part 44 in the sheet conveying direction Dc is curved convex to the left in FIG. 9, and an upstream part of the curved part 44 in the sheet conveying direction Dc is curved convex to the right side in FIG. 9. In other words, the curved part 44 has an inflection part 44*a* at a substantially middle part in the sheet conveying direction Dc. In this way, the upstream side area of the adjusting roller pair 51 in the sheet conveying direction Dc in the sheet conveying path 41 is formed in the S shape, viewed from the sheet width direction as illustrated in FIG. 9.

The second conveying roller pair 43 is disposed at the inflection part 44*a* of the curved part 44. The second conveying roller pair 43 is constituted of a drive roller 431 and a driven roller 432, for example. The drive roller 431 is rotated by a motor (not shown). The driven roller 432 has a periphery surface that contacts with a periphery surface of the drive roller 431, so as to rotate following rotation of the drive roller 431. The second conveying roller pair 43 holds and conveys the sheet S with a conveying nip formed between the drive roller 431 and the driven roller 432.

The contact-separation mechanism 45 is disposed adjacent to the driven roller 432 of the second conveying roller pair 43. The contact-separation mechanism 45 includes a biasing member 451 and a cam 452, for example. The biasing member 451 is constituted of a compression spring, for example, which is connected between a shaft 432*x* of the driven roller 432 and a frame member of the main body 2. The biasing member 451 biases the shaft 432*x* in such a direction that the driven roller 432 approaches the drive roller 431.

The cam 452 contacts with the shaft 432*x* or the like of the driven roller 432, for example. The cam 452 can rotate against biasing force of the biasing member 451, so as to move the shaft 432*x* in such a direction that the driven roller 432 separates from the drive roller 431. In this way, the contact-separation mechanism 45 allows the drive roller 431 and the driven roller 432 constituting the second conveying roller pair 43 to be close or apart from each other. In other words, the contact-separation mechanism 45 moves the driven roller 432, which is one conveying roller out of the drive roller 431 and the driven roller 432 constituting the second conveying roller pair 43, in the front and back side direction of the sheet S. The contact-separation mechanism 45 is controlled by the control unit 8.

When the contact-separation mechanism 45 conveys the sheet S without performing the skew correction or the positional displacement correction of the sheet S with the position adjusting mechanism 50, it brings the drive roller 431 and the driven roller 432 into contact with each other (see FIG. 9). In addition, when the contact-separation mechanism 45 performs the skew correction or the positional displacement correction of the sheet S with the position adjusting mechanism 50, it separates the drive roller 431 and the driven roller 432 from each other (see FIG. 10).

With the structure described above, when the position adjusting mechanism 50 is operated so as to perform the skew correction and the positional displacement correction, the adjusting roller pair 51 nips and conveys the sheet S together with the first conveying roller pair 42. In this way, the sheet S nipped by the adjusting roller pair 51 and the first conveying roller pair 42 is bent in an S shape viewed from the sheet width direction. As the sheet S is bent and curved so as to be convex in two directions, stretching, curving, and twisting can be sufficiently eliminated. Therefore, when the sheet S conveyed along the sheet conveying path 41 is adjusted at an appropriate position in the sheet conveying path 41, the sheet S can be adjusted without being strained.

In addition, the sheet conveying device 4 includes the second conveying roller pair 43 and the contact-separation mechanism 45 having the structure described above. With this structure, also in the sheet conveying path 41 adapted to conveying a small size of sheet S, the contact-separation mechanism 45 separates the drive roller 431 and the driven roller 432 from each other, so that the skew correction and the positional displacement correction can be performed. Therefore, when the sheet S adjusted at an appropriate position in the sheet conveying path 41 in the sheet conveying device 4 having various structures, the sheet S can be adjusted without being strained.

Figure 11:
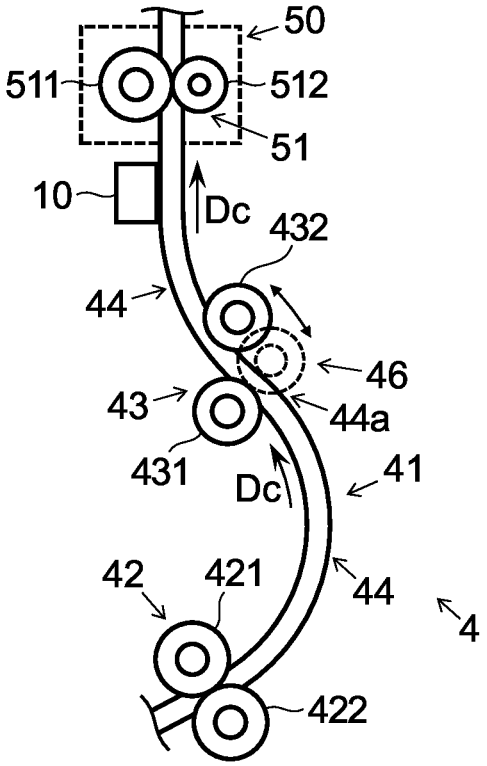
FIG. 11 is a schematic front view of the curved part of the sheet conveying path according to a variation.

FIG. 11 is a schematic front view of the curved part 44 of the sheet conveying path 41 in a variation. The sheet conveying path 41 in the variation includes a contact-separation mechanism 46. The contact-separation mechanism 46 is disposed adjacent to the driven roller 432 of the second conveying roller pair 43.

The contact-separation mechanism 46 moves at least one of the drive roller 431 and the driven roller 432 of the second conveying roller pair 43 in the sheet conveying direction Dc so that they are apart from each other. In this embodiment, the contact-separation mechanism 46 moves the driven roller 432 to the downstream side in the sheet conveying direction Dc so that the drive roller 431 and the driven roller 432 are apart from each other. The drive roller 431 and the driven roller 432 separated from each other contact with the sheet S at different positions in the sheet conveying direction Dc in the curved part 44.

Note that it may be possible to move the drive roller 431 in the sheet conveying direction Dc, or to move both the drive roller 431 and the driven roller 432 in opposite directions in the sheet conveying direction Dc. For instance, it may be possible to move the drive roller 431 to the downstream side in the sheet conveying direction Dc, and to move the driven roller 432 to the upstream side in the sheet conveying direction Dc.

With the structure of the variation, it is possible to enhance the effect of the driven roller 432, which is moved to the downstream side in the sheet conveying direction Dc, to bend the sheet S in a manner being convex in the front and back side direction in the curved part 44. Therefore, when adjusting the sheet S at an appropriate position in the sheet conveying path 41, it is possible to improve the effect of eliminating stretching, curving, and twisting.

In addition, the image forming apparatus 1 includes the sheet conveying device 4 having the structure described above for conveying the sheet S to the transfer unit 30. With this structure, when the image forming apparatus 1 adjusts the sheet S at an appropriate position in the sheet conveying path 41 before transferring an image onto the sheet S, it can adjust without straining the sheet S. Therefore, appropriate transfer of the image onto the sheet S can be realized.

Although the embodiment of the present disclosure is described above, the scope of the present disclosure is not limited to this description. The present disclosure can be variously modified for implementation within the scope the present disclosure without deviating from the spirit thereof.

For instance, the image forming apparatus 1 of the embodiment described above is a so-called tandem type image forming apparatus for color printing, in which images of a plurality of colors are sequentially overlaid, but this is not a limitation. The image forming apparatus may be an image forming apparatus for color printing that is not the tandem type, or may be an image forming apparatus for monochrome printing.

In addition, it may be also possible that the sheet conveying device 4 is mounted in an inkjet recording type image forming apparatus or in a sheet post processing device or the like, which performs post processing on sheets after image formation.

What is claimed is:

1. A sheet conveying device comprising:

a sheet detection unit disposed in a sheet conveying path, so as to detect skew of a conveyed sheet with respect to a sheet conveying direction, and to detect a positional displacement amount of the sheet in a sheet width direction perpendicular to the sheet conveying direction; and a position adjusting mechanism disposed in the sheet conveying path on a downstream side of the sheet detection unit in the sheet conveying direction, and configured to perform skew correction to correct the skew of the sheet, and to perform positional displacement correction to correct the positional displacement of the sheet on the basis of a detection result of the sheet detection unit, while conveying the sheet, wherein the position adjusting mechanism includes an adjusting roller pair configured to nip and convey the sheet, a skew correction motor configured to tilt rotation shafts of the adjusting roller pair with respect to the sheet conveying direction, and a positional displacement correction motor configured to move the adjusting roller pair in the sheet width direction, the sheet conveying path includes a first conveying roller pair disposed on an upstream side of the position adjusting mechanism in the sheet conveying direction, and a curved part disposed between the adjusting roller pair and the first conveying roller pair, the curved part curving in an S shape in a front and back side direction of the sheet, the adjusting roller pair nips and conveys the sheet together with the first conveying roller pair, the sheet conveying path includes a second conveying roller pair disposed at an inflection part of the curved part, and a contact-separation mechanism configured to bring two conveying rollers constituting the second conveying roller pair into contact with or separate from each other, when conveying the sheet without performing the skew correction or the positional displacement correction of the sheet with the position adjusting mechanism, the contact-separation mechanism brings the two conveying rollers into contact with each other, when performing the skew correction or the positional displacement correction of the sheet with the position adjusting mechanism, the contact-separation mechanism separates the two conveying rollers from each other, the contact-separation moves at least one of the two conveying rollers in the sheet conveying direction so that the two conveying rollers are separated from each other, and each of the two conveying rollers in a separated state comes in to contact with the sheet at different positions in the sheet conveying direction in the curved part.

2. The sheet conveying device according to claim 1, wherein the two conveying rollers includes a drive roller and a driven roller that follows the drive roller, and the contact-separation mechanism moves the driven roller in the sheet conveying direction.

3. An image forming apparatus comprising:

an image forming unit configured to form an image;

a transfer unit configured to transfer the image onto a sheet; and the sheet conveying device according to claim 1, configured to convey the sheet to the transfer unit.

* * * * *